United States Patent [19]

Sheffler et al.

[11] Patent Number: 4,583,692

[45] Date of Patent: Apr. 22, 1986

[54] SELF-CLEANING ACTUATOR BUTTON FOR DISPENSING LIQUIDS WITH PARTICULATE SOLIDS FROM A PRESSURIZED CONTAINER OR BY PISTON PUMP

[75] Inventors: Robert J. Sheffler, Morganville; Michael E. Radice, Colts Neck, both of N.J.; John E. Jedzinak, Suffern, N.Y.

[73] Assignee: Revlon, Inc., New York, N.Y.

[21] Appl. No.: 583,462

[22] Filed: Feb. 24, 1984

[51] Int. Cl.[4] ..... B05B 1/34

[52] U.S. Cl. ..... 239/405; 239/493

[58] Field of Search ..... 239/333, 492, , 405, 239/493, 494, 496, 478, 491, 497

[56] References Cited

U.S. PATENT DOCUMENTS

| | | | |
|---|---|---|---|
| 2,767,023 | 10/1956 | Venus, Jr. | 239/491 |
| 3,098,610 | 7/1963 | Stram | 239/492 X |
| 3,305,179 | 2/1967 | Lehmann | 239/337 |
| 3,406,913 | 10/1968 | Frangos | 239/543 |
| 3,416,737 | 12/1968 | Venus | 239/579 |
| 3,482,784 | 12/1969 | Webster | 239/493 |
| 3,504,862 | 4/1970 | Lowry | 239/565 |
| 3,519,210 | 7/1970 | DuPlain | 239/492 |
| 3,550,860 | 12/1970 | Dorman et al. | 239/491 |
| 3,568,933 | 3/1971 | Macguire-Cooper et al. | 239/543 |
| 3,570,770 | 3/1971 | Ewald | 239/337 |
| 3,628,733 | 12/1971 | Kahn | 239/337 |
| 3,652,018 | 3/1972 | Focht | 239/490 |
| 3,785,571 | 1/1974 | Hoening | 239/492 |
| 3,881,658 | 5/1975 | Greenbaum et al. | 239/492 |
| 3,994,442 | 11/1976 | Hoening | 239/472 |
| 4,020,979 | 5/1977 | Shay et al. | 222/211 |
| 4,071,196 | 1/1978 | Burke et al. | 239/492 |
| 4,074,861 | 2/1978 | Magera et al. | 239/492 |
| 4,087,050 | 5/1978 | Tsuji et al. | 239/490 |
| 4,260,110 | 4/1981 | Werding | 239/404 |
| 4,367,847 | 1/1983 | Bayer | 239/337 |
| 4,396,152 | 8/1983 | Abplanalp | 239/405 X |

*Primary Examiner*—Jeffrey V. Nase
*Assistant Examiner*—Daniel R. Edelbrock

[57] ABSTRACT

An actuator for a container that dispenses liquids containing a suspension of particulate material that keeps itself from clogging comprises a mechanical break-up chamber to emit a fine spray and includes a continuous emission from an orifice which keeps the chamber free from accumulation of solid particles.

5 Claims, 5 Drawing Figures

SELF-CLEANING ACTUATOR BUTTON FOR DISPENSING LIQUIDS WITH PARTICULATE SOLIDS FROM A PRESSURIZED CONTAINER OR BY PISTON PUMP

BACKGROUND OF THE INVENTION

This invention relates to spray dispensing bottles, cans, plastic containers and the like for dispensing particulate solids suspended in a liquid medium as one may find among cosmetic formulations, deodorants and antiperspirants, fragrances, lacquers and paints, household products and pharmaceutical preparations. Products of this nature may be contained in a pressurized package, or one which utilizes a spray dispensing piston pump.

A problem in dispensing these suspensions utilizing a mechanical break-up feature in the valve tip and insert assembly of an aerosol or pump package, is the accumulation of solids in the swirl chamber which causes the package to cease dispensing by clogging the chambers. These tips, referred to as actuators, must be replaced or cleaned so that the contents of the package are once again deliverable for use. The replacement or cleaning of the actuator may have to be repeated several times during the use of the entire package contents owing to repeated clogging.

Therefore, there is a need for a self-cleaning or non-clogging mechanical break-up spray system to provide functional dispensing of suspended solids in a liquid, for the life of the package.

SUMMARY OF THE INVENTION

The invention is a novel valve or pump tip structure which prevents clogging of the mechanical break-up chamber to emit a fine spray of particulate suspensions in liquids. It is a solid body having (a) a vertical axial passageway open at the bottom end for connection with the valve or pump stem which controls the flow from the vessel containing the product;

(b) a chamber formed in the surface of the solid body which enhances the production of a fine spray by turbulence, having
  (i) a circular channel;
  (ii) a central turbulence chamber which is concentric withinand coplanar with the circular channel; and
  (iii) three or more symmetrically spaced channels connecting the circular channel and the turbulence chamber which are tangent to the turbulence chamber;

(c) a primary feed cylindrical conduit for bringing product from the axial passageway to the circular channel, which is perpendicular to the plane of the circular channel and turbulence chamber;

(d) a second smaller cylindrical conduit for directing a secondary flow into the center of the turbulence chamber from the axial passageway, which is perpendicular to the plane of the circular channel and turbulence chamber; and (e) an orifice plate through which the product ultimately sprays from the actuator, also closing off the plane of the turbulence chamber so that the flow of product proceeds through the channels in proper sequence. The orifice in the plate is centered with respect to the turbulence chamber and secondary conduit from the axial passageway.

DESCRIPTION OF DRAWINGS

The invention will be more fully understood by reference to the drawings in which.

DETAILED DESCRIPTION OF THE INVENTION

This invention is applicable to pressure containers which dispense liquids containing particulate solids, e.g. solids less than 0.022 inches in size. Pressure can be supplied by a pressurizing medium such as blends of chlorofluorocarbons, hydrocarbons, carbon dioxide, or dimethyl ether, in which the user depresses the valve tip or actuator to release the pressurized product into the actuator. Instead of using a pressurized propellant, the same type of product movement may be produced from actuating a pump mounted in and sealed to the container. Depressing the actuator or tip moves a piston through a cylindrical tank which is inside the container. The workings of an aerosol valve and a pump are entirely conventional and well known to those who possess normal skill in packaging science. Use of pumps and pressurized containers are conventional to the packaging art.

Figure 1:
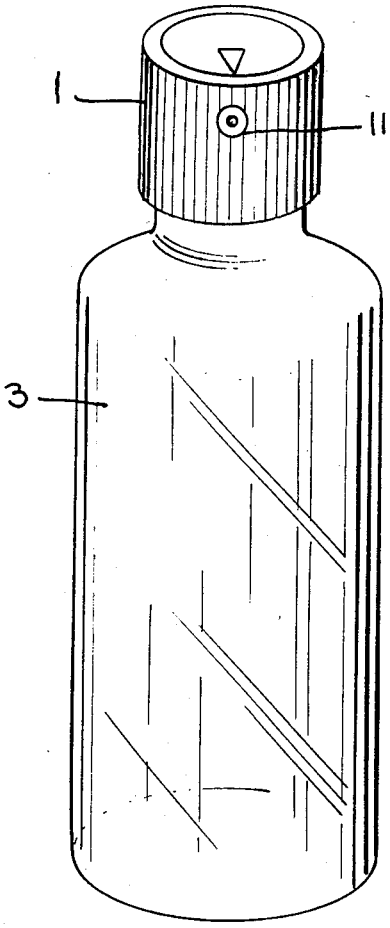
FIG. 1 is a perspective view of the actuator in position on a typical container.
Figure 2:
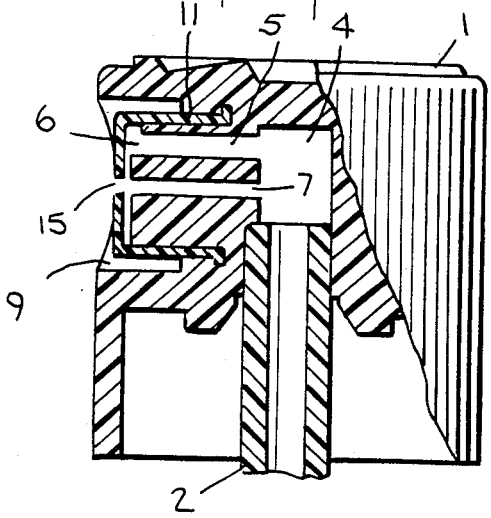
FIG. 2 is a cross-sectional view of the actuator taken through a plane passing through the central vertical axis and the turbulence chamber of the invention.

Referring to the drawings, and particularly to FIGS. 1–2, in any of the embodiments described heretofore, the valve or pump tip 1, also known as an actuator, is attached to a valve or pump stem 2 by friction. The valve or pump stem is mounted and sealed to container 3. Stem 2 has a center bore, and serves to convey the product from the container to the actuator.

Reference is now made to FIG. 2. Actuator 1 is presented in cros-section to reveal an axial passageway 4 which receives at the bottom end, stem 2. The joining is a fluid-tight and pressure-tight connection. A primary feed conduit 5 connects the axial passageway to a circular channel 6, which is more clearly depicted in FIGS. 3–4. A secondary feed conduit 7 connects the axial passageway to the center of turbulence chamber 8. A cylindrical blind channel 9 receives the orifice insert 11, also shown in FIG. 5.

Figure 4:
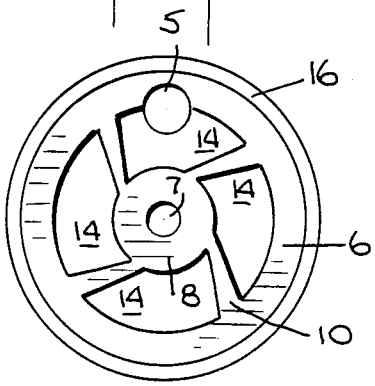
FIG. 4 is a frontal view of the turbulence chamber.
Figure 3:
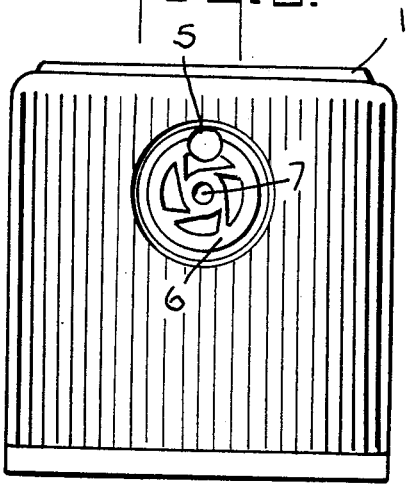
FIG. 3 is a frontal view of the actuator from which the orifice plate insert has been removed to expose the turbulence chamber.
Figure 5:
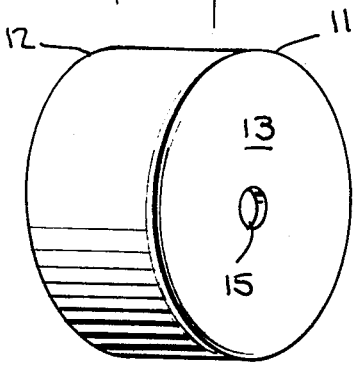
FIG. 5 is a perspective view of the orifice plate insert.

FIGS. 3–4, frontal views, show the circular channel 6, the turbulence chamber 8, and the ends of the feed conduits 5 and 7. Chamber 8 is concentric and coplanar with channel 6. From three to six (in these FIGS: 4) channels 10 direct the primary flow from the circular channel 6 tangentially into the turbulence chamber 8. By "tangentially" we mean not only tangential to the outer edge of turbulence chamber 8, but also into the interior of that chamber so long as it is not along a radius. These channels 10 are symmetrically positioned with respect to the chamber 8. The secondary feed conduit 7 terminates at the center of the turbulence chamber 8.

Located across the front of the actuator, and friction fitted into position is orifice plate face 13, shaped in the general contour of a cup, with a single center orifice 15. The leading edge 12 fits into the blind channel 9, pressed fitted until the inner surface of face 13 seals against the surfaces 14 and 16. Then product must pass from channel 6 into chamber 8 only by flowing through channels 10. Orifice 15 is located directly in the center of orifice insert face 13; therefore, it is also centered over turbulence chamber 8 and the end of secondary conduit 7.

Actuator 1 with passageways, conduits, chamber and channels can be molded readily from most thermoplastic resins, such as polyethylene, polypropylene, nylon, and equivalent materials. Orifice insert 11 could also be made of the same materials, but more conveniently is aluminum or another relatively corrosion resistant metal.

When the actuator is depressed which either forces or allows the product to be dispensed into the axial passageway 4, the stream divides into conduits 5 and 7. The diameter of the primary conduit 5 is about 45%–55% greater than the diameter of secondary conduit 7. Accordingly, about 2¼ as much product streams through conduit 5 as does through conduit 7. The liquid and suspended particulates flowing through conduit 5 continue into circular channel 6 and then through all the tangential channels 10 into the turbulence chamber 8, where the swirling and impinging streams cause a break-up of the liquid into a fine spray, emitting through orifice 15. In the turbulence chamber 8, there is a tendency for the solid particulates to deposit behind the orifice insert. The effluent stream of product jetting from conduit 7 continually discourages the deposition of particulates so that the turbulence chamber 8 remains free from solids and safe from clogging.

The ratio of the diameters of the primary conduit 5 to the secondary circuit 7 is 3:2, plus or minus 10%, and preferably 3:2. This ratio is critical to achieving a fine spray without clogging by particulates. The ratio of the diameters of the conduit 5 to the terminal orifice in the insert 15 is 2:1 plus or minus 10%, and is also critical in achieving a fine spray without clogging by particulates. The other functionally important ratio of diameters is the relationship between the terminal orifice 15 and turbulence chamber 8. This ratio can be 0.030 to 0.035, and preferably is 8:25, or 0.32, plus or minus 10%. Furthermore, the diameter of the primary conduit can be 90%–110% greater than that of the terminal orifice 15. The terminal orifice diameter should be in the range 0.012–0.022 inches, preferably about 0.017 inches. Accordingly, the following typical diameters would be functionally effective:

| | |
|---|---|
| Primary Conduit 5: | .033 inches |
| Secondary Conduit 7: | .022 inches |
| Terminal Orifice 15: | .016 inches |
| Turbulence Chamber 8: | .050 inches |

The description herein, and the Figures, illustrate the embodiment of the invention that will be most frequently employed, in which the circular channel and the turbulence chamber lie in a vertical plane so that product is sprayed in a generally horizontal direction. This invention can also be used to advantage where the chamber is in another plane so that product is sprayed at an angle off horizontal, provided that the relationships described herein are adhered to and the two conduits are perpendicular to the plane of the circular channel and turbulence chamber.

What is claimed is:

1. A valve or pump actuator for dispensing a particulate-containing fluid therethrough, comprising a solid body having (a) a vertical axial passageway open at the bottom end for connection with the valve or pump stem of a container which controls the flow of product from the container;

(b) A chamber formed in the surface of the solid body which enhances the production of a fine spray by turbulence, having (i) a circular channel;

(ii) a central turbulence chamber which is concentric within, and coplanar with, the circular channel; and (iii) three or more symmetrically spaced channels connecting the circular channel and the turbulence chamber, and which are tangent to the turbulence chamber;

(c) a primary feed cylindrical conduit connecting the vertical axial passageway and the chamber for bringing product from the axial passageway to the circular channel, which is perpendicular to the plane of the circular channel and turbulence chamber;

(d) a second smaller cylindrical conduit in fluid communication with the vertical axial passageway for directing a secondary flow into the center of the turbulence chamber from the axial passageway, which is perpendicular to the plane of the circular channel and turbulence chamber; and (e) an orifice plate which closes off the turbulence chamber so that the product can flow from the circular channel to the turbulence chamber only through the symmetrically spaced channels, the plate with an orifice having a diameter size such that the ratio of the diameter of the primary feed cylindrical conduit to said orifice diameter is at least about 2:1 plus or minus 10% whereby the diameter of the primary conduit is 90%–110% greater than that of the terminal orifice, said orifice being centered with respect to the turbulence chamber and the secondary conduit, said primary conduit being 45%–55% greater in diameter than the secondary conduit, and the ratio of the terminal orifice diameter to that of the turbulence chamber being in a range of from about 0.30 to 0.35.

2. The actuator of claim 1 wherein the circular channel and the turbulence chamber lie in a vertical plane.

3. A container which is adapted to discharge its contents through a stem under pressure or by means of a pump, which has an actuator as claimed in claim 1 mounted on the stem.

4. A container as claimed in claim 3 which contains a suspension of particulate solids in a liquid.

5. The actuator of claim 1 wherein said orifice is from about 0.012 to about 0.022 inches in diameter.

* * * * *